US008047818B2

(12) United States Patent
Sorensen

(10) Patent No.: US 8,047,818 B2
(45) Date of Patent: Nov. 1, 2011

(54) HIGH PRESSURE, MULTIPLE-STAGE AIR PUMP WITH VALVE BODY INLET PORT ARRANGEMENT

(76) Inventor: Duane A. Sorensen, Cleburne, TX (US)

( * ) Notice: Subject to any disclaimer, the term of this patent is extended or adjusted under 35 U.S.C. 154(b) by 665 days.

(21) Appl. No.: 12/122,882

(22) Filed: May 19, 2008

(65) Prior Publication Data

US 2009/0285697 A1 Nov. 19, 2009

(51) Int. Cl.
*F04B 25/04* (2006.01)
*F04B 37/12* (2006.01)

(52) U.S. Cl. ..... 417/469; 417/258; 417/521

(58) Field of Classification Search ..... 417/254, 417/258, 469, 517, 544, 518, 521
See application file for complete search history.

(56) References Cited

U.S. PATENT DOCUMENTS

| | | | | |
|---|---|---|---|---|
| 817,538 | A * | 4/1906 | Wixon | 417/258 |
| 882,215 | A * | 3/1908 | Stapley | 417/254 |
| 1,187,835 | A * | 6/1916 | Hill | 417/248 |
| 1,332,995 | A * | 3/1920 | Nolda | 417/569 |
| 1,721,127 | A * | 7/1929 | Lilly | 417/460 |
| 3,257,960 | A * | 6/1966 | Keel | 417/269 |
| 3,650,639 | A * | 3/1972 | Greene et al. | 417/368 |
| 5,681,154 | A * | 10/1997 | Yang | 417/512 |
| 5,885,061 | A | 3/1999 | Olofsson et al. | |
| 6,190,142 | B1 * | 2/2001 | Wu | 417/523 |
| 6,371,741 | B1 * | 4/2002 | Wu | 417/446 |
| 6,702,556 | B2 * | 3/2004 | Axelsson | 417/523 |
| 7,104,276 | B2 * | 9/2006 | Einhaus | 137/512 |

FOREIGN PATENT DOCUMENTS

| | | | |
|---|---|---|---|
| GB | PCT/2002/005570 B1 | | 1/2003 |
| GB | 2398354 A | * | 8/2004 |
| WO | WO 03/052270 A1 | * | 6/2003 |

* cited by examiner

*Primary Examiner* — Devon C Kramer
*Assistant Examiner* — Nathan Zollinger
(74) *Attorney, Agent, or Firm* — Dan Brown Law Office; Daniel R. Brown

(57) ABSTRACT

A multiple-chamber, multiple-stage reciprocal pump for compressing air through a series of up-strokes and down-strokes. The pump includes an upper reciprocal portion and a fixed portion. The fixed portion further includes a base housing with an ambient air inlet cavity and a compressed air outlet cavity formed therein. It further includes an outlet valve body fixed to the base housing with an outlet valve pneumatically coupled to direct high-pressure compressed air into the outlet cavity. The outlet valve body also has an inlet port pneumatically coupled to the inlet cavity, and there are plural cylinders coupled to the outlet valve body, which slideably and sealably engaged with the upper reciprocal portion, thereby enabling the series of up-strokes and down-strokes to compress air.

16 Claims, 6 Drawing Sheets

Initial Intake
Up-Stroke

Secondary
Compression
Up-Stroke

Final
Compression
Down-Stroke

HIGH PRESSURE, MULTIPLE-STAGE AIR PUMP WITH VALVE BODY INLET PORT ARRANGEMENT

BACKGROUND OF THE INVENTION

1. Field of the Invention

The present invention relates to air pumps. More specifically, the present invention relates to hand-operated, multi-chambered, multi-stage, high-pressure, reciprocating air pumps.

2. Description of the Related Art

Simple hand operated reciprocal air pumps, such as bicycle tire pumps, have been available for many decades. A cylinder and piston within the pump provide a single-action compression system that generally dawns in ambient air on the up-stroke and then compresses the air on the down-stroke. Check valves are employed on the inlet and compressed air outlet of the pump, such that a series of reciprocal stokes can be employed to gradually build up the air pressure at the outlet, which may be connected to a pneumatic tire, a storage tank, or other air receiving container. The compression ratio of the pump limits the maximum pressure that can be developed, which is approach asymptotically. The maximum compression ratio is dictated by the displacement ratio between the volume of the fully open cylinder on the upstroke and the fully closed cylinder on the down-stroke. More efficient versions of such pumps may be configured to compress air on both the up-stroke and the down-stroke. Such pumps are single stage pumps and typically can yield 125 psi, perhaps 250 psi in a high performance design.

There are applications which require much higher operating pressure, such as compressed air tanks used for regulated breathing, air tools, and other applications. One application where high pressure air is required is with high performance air rifles. Such rifles rival performance of light caliber firearms, and may yield muzzle velocities approaching 1200 fps. In order to achieve such velocities, an air reserve tank is coupled to the rifle that provides air pressure in the 2000 psi to 3600 psi range. Air rifle users employ manually operated reciprocal air pumps to fill such tanks. However, the high pressures needed cannot be achieved with a single stage reciprocal pump. Multi-stage pumps are needed to achieve these pressure levels. Multi-stage reciprocal air pumps are known, which can achieve compressed air outlet pressures in excess of 2000 psi. Multi-stage multi-chamber pumps generally employ plural concentric cylinders divided into plural chambers using seals of various types and pistons, with successively smaller displacement volumes that enable the inlet air to be compressed to high levels through multiple stages of compression.

As the level of compression of the outlet air rises, so too does the number of mechanical and operation issues in the design and operation of the pump. While a simple bicycle pump can function without lubrication in the presence of dust and moisture, and suffice with leather flaps for a check valves, high pressure pumps will develop a number of operational problems, and have a greatly reduced useful life in the same environment. Even considering just the ideal gas law, those skilled in the art will appreciated the highly elevated temperature rise between the inlet ambient air and the compressed outlet air in a high pressure reciprocal pump. Heat, with that addition of dust, particulate or moisture, greatly challenges the design process. Design factors quickly become critical as the target outlet pressure increases. Such design problems can be partially overcome using higher quality materials, higher performance lubricants, and tighter design specifications, however, it must be appreciated that such refinements come at increased production costs. Consumers of such pumps may be unwilling to pay the additional cost of such refinements. Thus it can be appreciated that there is a need in the art for a high pressure, multiple-stage, multiple chamber reciprocal air pump that can achieve high pressure, have an adequately long useful life, yet be provided at a competitive price point so as to be desirable to consumers.

SUMMARY OF THE INVENTION

The need in the art is addressed by the apparatus of the present invention. A multiple-chamber, multiple-stage reciprocal pump for compressing air through a series of up-strokes and down-strokes is taught. The pump includes an upper reciprocal portion and a fixed portion. The fixed portion further includes a base housing with an ambient air inlet cavity and a compressed air outlet cavity formed therein. It further includes an outlet valve body fixed to the base housing with an outlet valve pneumatically coupled to direct high-pressure compressed air into the outlet cavity. The outlet valve body also has an inlet port pneumatically coupled to the inlet cavity, and there are plural cylinders coupled to the outlet valve body, which slideably and sealably engaged with the upper reciprocal portion, thereby enabling the series of up-strokes and down-strokes to compress air.

In a specific embodiment of the foregoing pump, the inlet port is arranged in thermally conductive proximity to the outlet valve, thereby enabling transfer of heat from compressed outlet air to ambient inlet air. In another specific embodiment, the inlet cavity is arranged in thermally conductive proximity to the outlet valve body, thereby enabling transfer of heat from compressed outlet air to ambient inlet air. In another specific embodiment, the inlet air cavity and the inlet air port are pneumatically coupled by an annular cavity formed between the base housing and the outlet valve body. In a refinement to this embodiment, the annular cavity is arranged in thermally conductive proximity to the outlet valve, thereby enabling transfer of heat from compressed outlet air to ambient inlet air.

In a specific embodiment, the foregoing pump further includes an inlet air filter coupled to the inlet air cavity for filtering ambient air prior to entering the reciprocal pump. In another specific embodiment, the inlet air cavity and inlet air port are arranged in thermally conductive proximity to the outlet valve and the outlet air cavity, thusly enabling transfer of heat from compressed outlet air to ambient inlet air. In another specific embodiment, the pump further includes a handle coupled to the upper reciprocal portion to facilitate manual operation of the reciprocal pump. In another specific embodiment, the base housing has cooling fins formed on the exterior surface thereof to facilitate heat transfer from the base housing to the ambient environment.

The present invention also teaches a reciprocal pump for compressing air by a series of up-strokes and down-strokes. The pump includes a reciprocal portion, comprising an outer cylinder having a closed top at the upper end and a seal assembly at a lower end, and a piston rod, co-axially disposed within the outer cylinder, and fixed to the closed top at the upper end, and having a piston fixed to the lower end, the piston having a piston valve. The pump also includes a fixed portion, comprising a base housing with an ambient air inlet cavity and a compressed air outlet cavity formed therein, and an outlet valve body fixed to the base housing having an outlet valve pneumatically coupled to the outlet cavity, and having an inlet port pneumatically coupled to the inlet cavity. The fixed portion also includes a middle cylinder coupled to the outlet valve body at the lower end and coupled to a transfer valve body at the upper end, and an inner cylinder coaxially disposed within the middle cylinder, and coupled to the outlet valve body at the lower end and coupled to the transfer valve body at the upper end, and wherein the middle cylinder and the inner cylinder form an inlet annular chamber therebetween, which is bounded by the inlet valve body and the transfer valve body, and the inlet annular chamber is pneumatically coupled to the inlet port. The two portions are arranged and operates as follows. The reciprocal portion slideably engages the fixed portion, and thusly enables the sequence of up-strokes and down-strokes. The outer cylinder, the middle cylinder, the inner cylinder and the piston rod are coaxially arranged in respective order of decreasing diameters. The transfer valve body sealably engages the piston rod and sealably engages the interior surface of the outer cylinder, thereby defining an upper annular chamber bounded by the transfer valve body and the closed top. The transfer valve body further includes an inlet valve disposed to direct the flow of air from the inlet air chamber into the upper annular chamber on the up-stroke. The seal assembly sealably engages the exterior surface of the middle cylinder, and thereby defines a lower annular chamber bounded by the seal assembly and the transfer valve body. The transfer valve body further includes a transfer valve disposed to direct the flow of air from the upper annular chamber to the lower annular chamber on the down-stroke. The piston sealably engages the interior of the inner cylinder and thereby defines a rod chamber bounded by the piston and the transfer valve body, and further defines a piston chamber bounded by the piston and the outlet valve body. The transfer valve body further includes a transfer port disposed to allow air to flow from the lower annular chamber into the piston rod chamber on the up-stroke. The piston valve directs the flow of air from the rod chamber to the piston chamber on the up-stroke, and the outlet valve directs air the flow from the piston chamber to the outlet cavity on the down-stroke.

In a specific embodiment of the foregoing pump, the inlet port is arranged in thermally conductive proximity to the outlet valve, thereby enabling transfer of heat from compressed outlet air to ambient inlet air. In another specific embodiment, the inlet cavity is arranged in thermally conductive proximity to the outlet valve body, thereby enabling transfer of heat from compressed outlet air to ambient inlet air. In another specific embodiment, the inlet air cavity and the inlet air port are pneumatically coupled by an annular cavity formed between the base housing and the outlet valve body. In a refinement to this embodiment, the annular cavity is arranged in thermally conductive proximity to the outlet valve, thereby enabling transfer of heat from compressed outlet air to ambient inlet air.

In a specific embodiment, the foregoing pump further includes an inlet air filter coupled to the inlet air cavity for filtering ambient air prior to entering the reciprocal pump. In another specific embodiment, the inlet air cavity and inlet air port are arranged in thermally conductive proximity to the outlet valve and the outlet air cavity, thusly enabling transfer of heat from compressed outlet air to ambient inlet air. In another specific embodiment, the pump further includes a handle coupled to the closed end to facilitate manual operation of the reciprocal pump. In another specific embodiment, the base housing has cooling fins formed on the exterior surface thereof to facilitate heat transfer from the base housing to the ambient environment.

DESCRIPTION OF THE INVENTION

Figure 1:
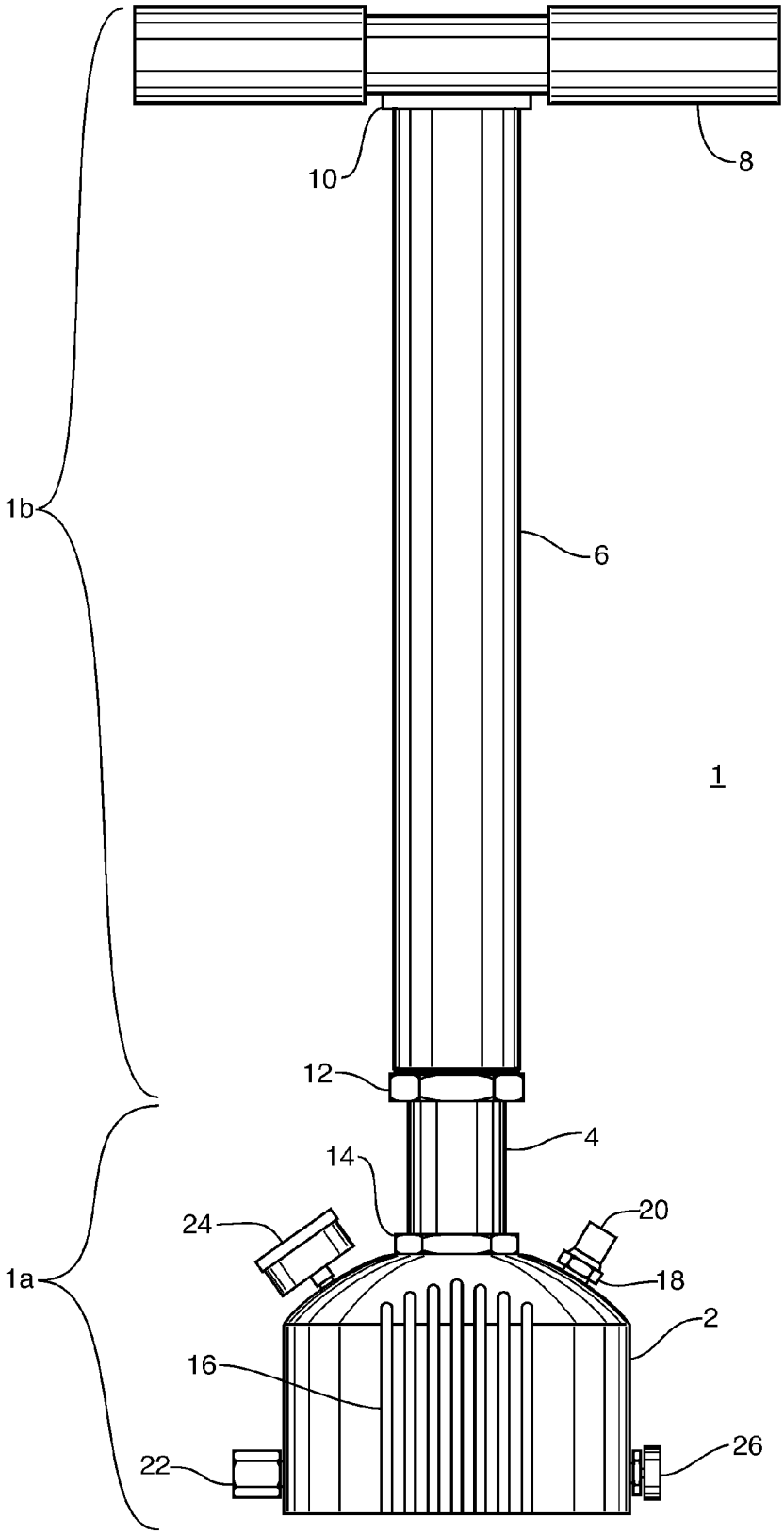
FIG. 1 is a drawing of a reciprocal pump according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus. Accordingly, the apparatus components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The teachings herein address the problems in the art with a multiple stage reciprocal air pump that employs a base housing and outlet valve body that manage both the flow of both inlet air and compressed outlet air such that inlet air is drawn from a fixed location that is filtered and may optionally include a desiccant cartridge. The inlet air is routed in thermal proximity to the outlet valve such that heat is drawn away from the outlet valve body, thereby mitigating certain issues that arise where high compression levels are employed. In addition, the entire pump profile has a clean appearance since all of the pneumatic interfaces are made to the base housing, leaving the rest of the pump uncluttered in appearance.

Reference is directed to FIG. 1, which is a drawing of a reciprocal pump 1 according to an illustrative embodiment of the present invention. The appearance of the pump is clean, with all of the pneumatic interfaces made through cavities formed in the base housing 2. The interfaces include the air inlet filter 18, which has a desiccant cartridge 20 affixed thereto, a compressed air outlet fitting 22, a compressed air outlet pressure gauge 24, and an outlet cavity pressure bleed valve 26. In addition, the base housing 2 includes plural cooling fins 16, which are formed on the exterior surface thereof for promoting the circulation of ambient air, which provides additional cooling of the outlet valve assemblies disposed within the base housing 2. In the illustrative embodiment, the base housing 2 is machined from a solid block of aluminum alloy. The pneumatic fittings are brass, and generally comply with promulgated threaded pipe fitting standards. The compressed air bleed valve 26 is a needle valve that enables the user to relieve the pressure within the base housing 2 prior to connecting and disconnecting a compressed air storage tank (not shown) to the compressed air outlet fitting 22. The inlet air fitting 18 is brass, and includes a sintered bronze inlet filter, although those skilled in the art will appreciated that other types of filters are suitable for the removal of dust and particulate from the inlet air stream. In the illustrative embodiment, a silica gel desiccant cartridge 20 is coupled to the inlet fitting 18, which removes moisture from the inlet air as it flows therethrough.

The base housing 2 in FIG. 1 rests on a horizontal surface and may further include a base foot (not shown) to add stability to the pump assembly. The base housing is a component of a fixed portion 1*a* of the pump, which also includes an outlet valve body 14 and a middle cylinder 4, which are visible in FIG. 1. Other components of the fixed portion 1*a* will be described hereinafter. These components generally remain stationary during reciprocal activation of the pump. The reciprocal portion 1*b* of the pump includes an outer cylinder 6, a seal 12, and closed end 10 of the outer cylinder 6, and a handle 8. The reciprocal portion 1*b* is slideably and sealably engaged with the fixed portion 1*a*. In typical operation, the pump 1 placed on the ground and a user stands over the pump 1. The handle 8 of the reciprocal portion 1*b* is grasped, and manually reciprocated through repetitive up-strokes and down-strokes with respect to the fixed portion 1*a*, thereby activating the intake, compression, and outlet cycles of the pump 1.

Figure 2:
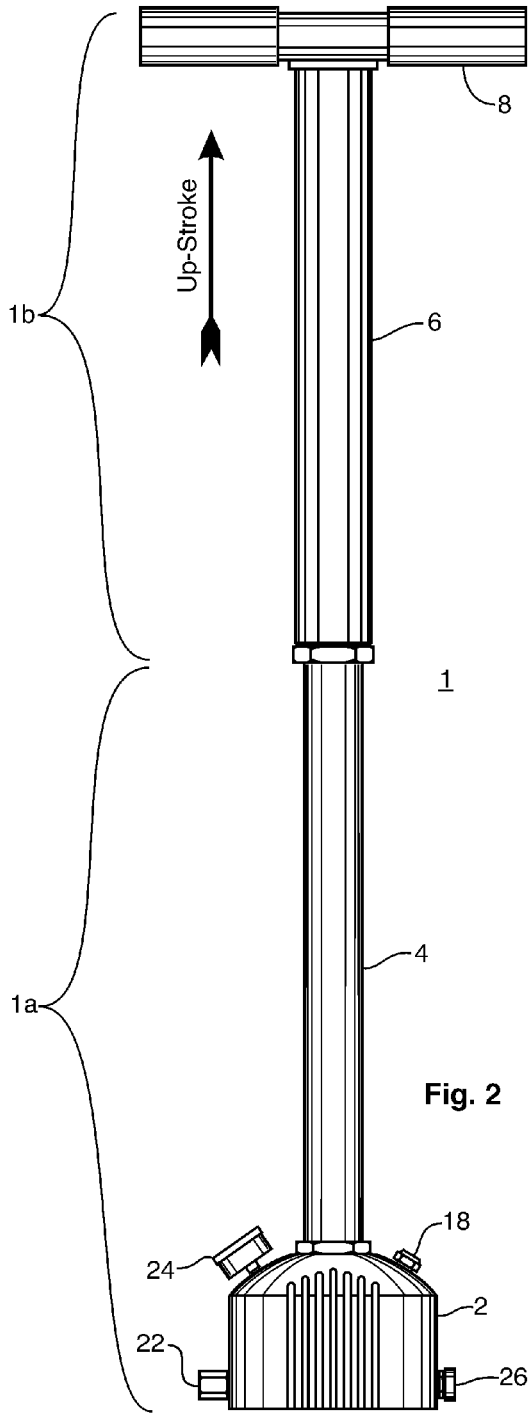
FIG. 2 is a drawing of a reciprocal pump fully extended on the up-stroke according to an illustrative embodiment of the present invention.
Figure 3:
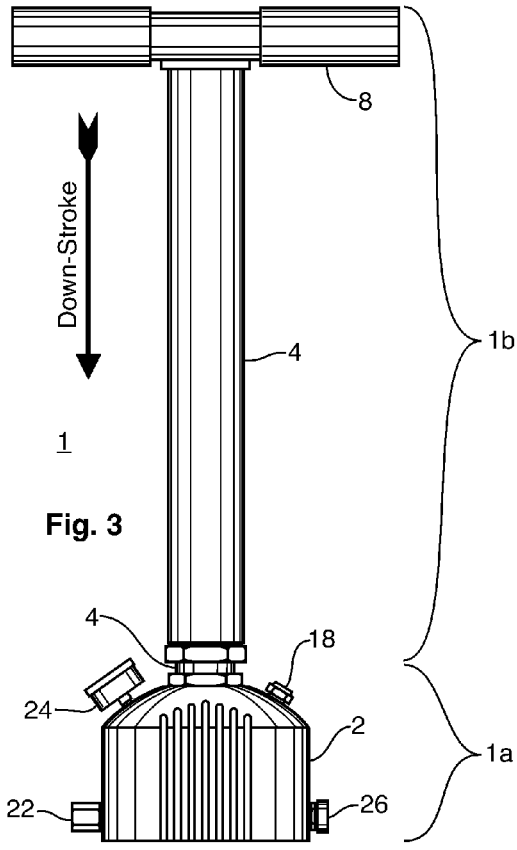
FIG. 3 is a drawing of a reciprocal pump fully compressed on the down-stroke according to an illustrative embodiment of the present invention.

Reference is directed to FIG. 2 and FIG. 3, which are drawings of a reciprocal pump 1 fully extended on the up-stroke and fully compressed on the down-stroke, respectively, according to an illustrative embodiment of the present invention. On the up-stroke in FIG. 2, the reciprocal portion 1*b* of the pump 1 is drawn upwardly to a fully extended position. This action draws a fresh charge of ambient air into the pump 1 through the air inlet fitting 18. In addition, a secondary compression action occurs within the pump 1 during the up-stroke, which will be more fully discussed hereinafter. On the down-stroke in FIG. 3, the reciprocal portion 1*b* is fully compressed downwardly over the fixed portion 1*a*. This action causes a final compression action to force compressed air out of the outlet fitting 22. In addition, an initial compression action occurs within the pump 1, which will be more fully discussed hereinafter. Through a repetitive series of up-strokes and down-strokes, the pressure level at the output of the pump 1 and within an attached air storage tank (not shown) gradually increases until the desired pressure level is achieved, as indicated on the pressure gauge 24.

Figure 4:
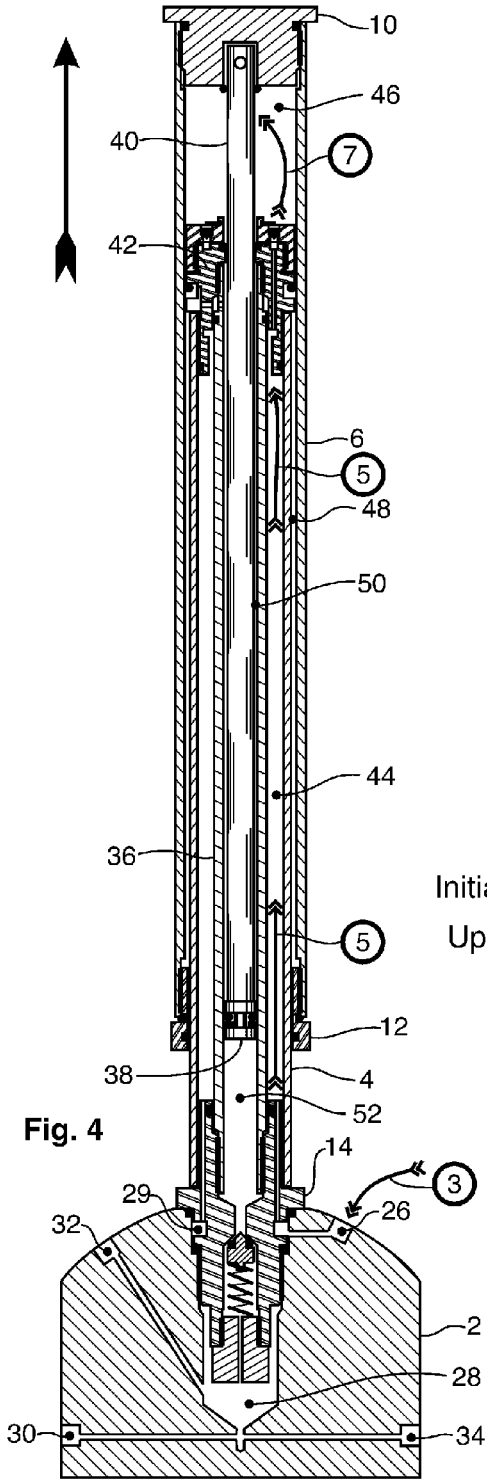
FIG. 4 is a section view drawing of a reciprocal pump illustrating the intake airflow on the up-stroke according to an illustrative embodiment of the present invention.
Figure 5:
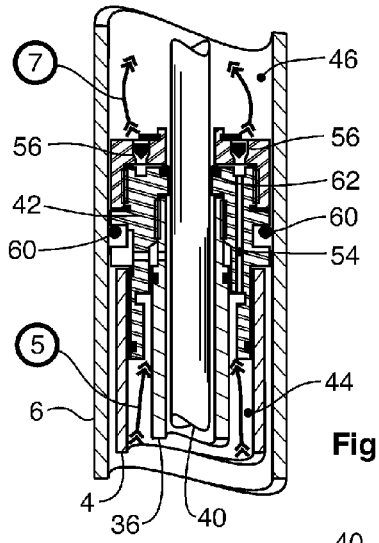
FIG. 5 is a detailed section view drawing of a reciprocal pump illustrating the intake airflow on the up-stroke according to an illustrative embodiment of the present invention.
Figure 6:
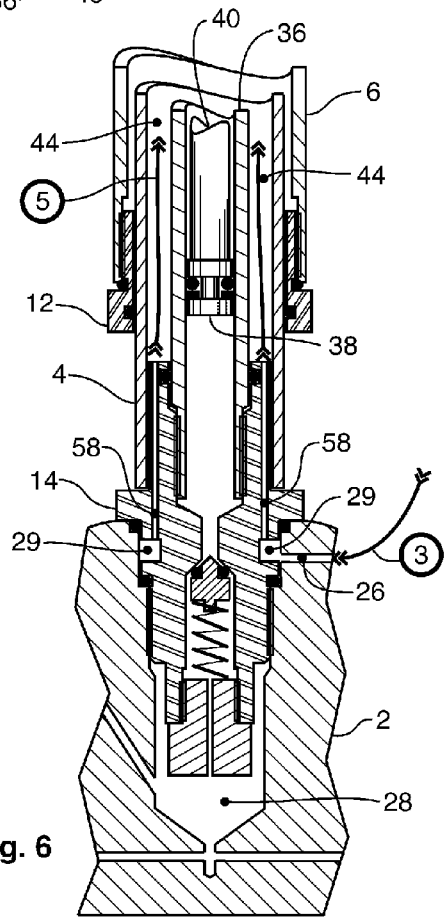
FIG. 6 is a detailed section view drawing of a reciprocal pump illustrating the intake airflow on the up-stroke according to an illustrative embodiment of the present invention.

Reference is directed to FIG. 4, FIG. 5, and FIG. 6, which are section view drawings, including detailed section views, of a reciprocal pump illustrating the intake airflow on the up-stroke according to the illustrative embodiment of the present invention. During the up-stroke, two pump actions occur, and these are the initial intake and the secondary compression actions. FIGS. 4, 5, and 6 are presented to illustrate the initial intake action only. The secondary compression action will be discussed hereinafter. The base housing 2 is machined with a series of cavities used to route airflow through the pump. Among these is the outlet cavity 28, which is pneumatically coupled to plural threaded ports, which engage the various pneumatic connections. These include the outlet fitting port 30, the pressure gauge port 32, and the pressure bleed valve port 34. The outlet valve body 14 is threadably engaged with the base housing 2 and delivers compressed outlet air into the outlet air cavity 28. When the outlet valve body 14 is engaged with the base housing, a machined cavity therebetween is formed as an annular inlet air cavity 29 about the outer periphery of the outlet valve body 14. The annular cavity portion 29 is pneumatically coupled to the inlet air cavity 26 in the base housing, which is where the inlet air 3 enters the base housing 2. Thus, the inlet air is in thermal proximity with the base housing 2 and the outlet valve body 14. An inlet air port 58 is formed through the outlet valve body that pneumatically couples the inlet annular cavity 29, 26 into an inlet annular chamber 44 formed between the middle cylinder 4 and an inner cylinder 36, both of which are coupled to the outlet valve body 14. Thus, air flows 3 into the inlet air cavity 26 and flows through 5 the inlet annual chamber 44. At the upper end of the middle cylinder 4 and the inner cylinder 36 is the transfer valve body 42.

On actuation of an up-stroke, inlet air flows 5 through the inlet annular chamber 44, through a port 54 in the transfer valve body 42, and through an inlet check valve 56 into 7 an upper annular chamber 46. The upper annular chamber 46 is formed between the outer cylinder 6 and a piston rod 40, and is bounded at the lower end by the transfer valve body 42 and the upper end by a closed end 10 of the outer cylinder 6. The transfer valve body 42 includes a seal 60 that engages the interior surface of the outer cylinder 6, and another "O"-ring seal 62 that engages the piston rod 40. Thusly, the upper annular chamber 46 is essentially airtight, except for the air allowed to pass 7 thereinto through the inlet valve 56. Therefore, when the reciprocal portion is drawn upwardly, a vacuum is formed in the upper annular chamber 46, which draws the air flow 3 into the base housing 2, upwardly 5 through the inlet annular chamber 44, through the inlet valve 56 and into 7 the upper annular chamber 46. It should be noted that the seal 60 between the transfer valve body 42 and the outer cylinder includes an 'O'-ring that shifts within an annular groove on the outer periphery of the transfer valve body 42. The shift in the "O"-ring position is caused by the relative movement of the outer cylinder 6 with respect to the transfer valve body 42. On the up-stroke, the shift in position of the "O"-ring perfects the seal 60 between the outer cylinder 6 and the transfer valve body 42. The action of seal 60 on the down-stroke induces a check valve function, which will be discussed hereinafter.

Figure 7:
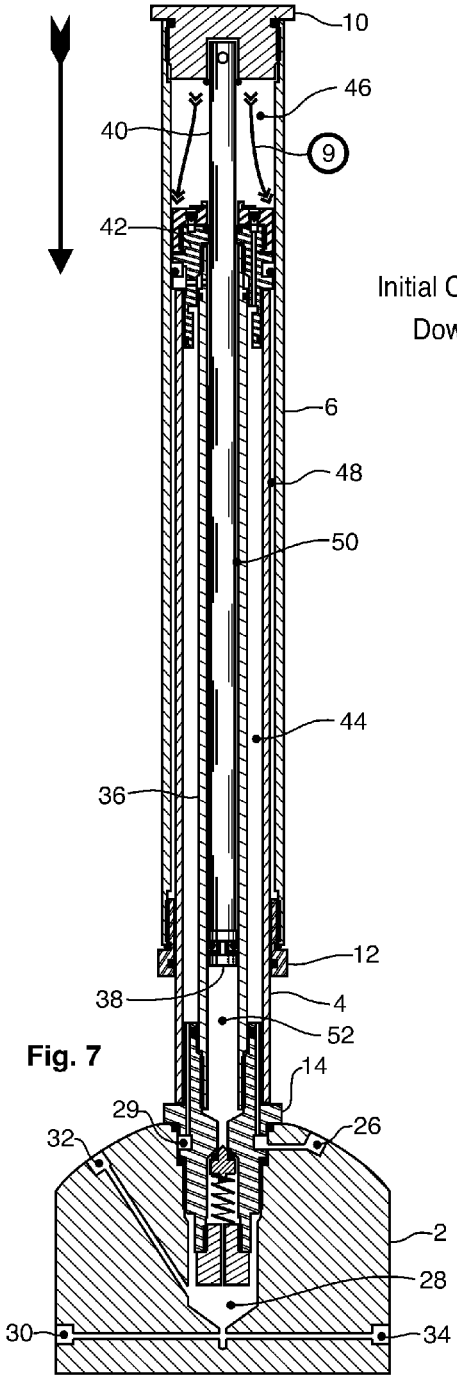
FIG. 7 is a section view drawing of a reciprocal pump illustrating the initial compression stage on the down-stroke according to an illustrative embodiment of the present invention.
Figure 8:
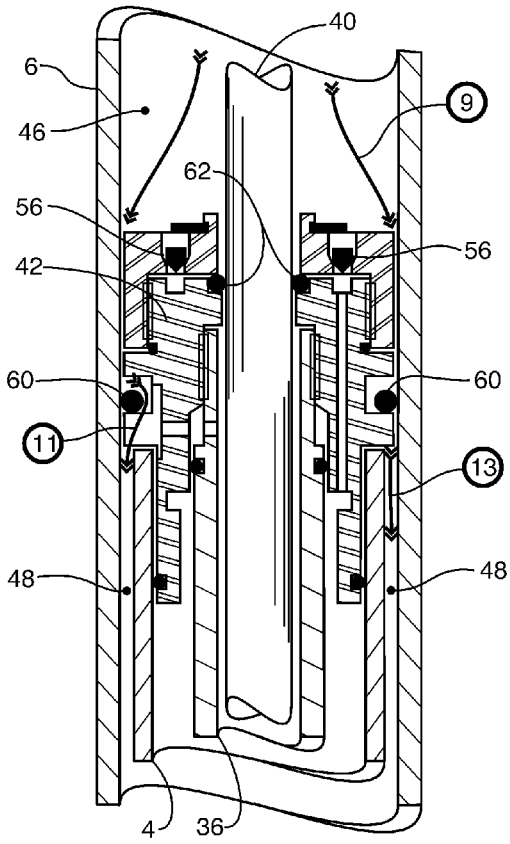
FIG. 8 is a detailed section view drawing of a reciprocal pump illustrating the initial compression stage on the down-stroke according to an illustrative embodiment of the present invention.

Reference is directed to FIG. 7, and FIG. 8 which are section view drawings of a reciprocal pump, including a detailed section view, illustrating the initial compression stage on the down-stroke according to an illustrative embodiment of the present invention. During the down-stroke action, two pump actions occur, and these are the initial compression and the final compression actions. FIGS. 7 and 8 are presented to disclose the initial compression action only. The final compression action will be discussed hereinafter. With the upper annular chamber 46 having been charged with fresh intake air on the previous up-stroke, the subsequent down-stroke initiates the compression of this air charge. The air 9 is compressed and forced downwardly. As the outer cylinder 6 begins downward movement, the "O"-ring of seal 60 on the transfer valve body is shifted downwardly, which exposes a grooved recess on the transfer valve body t h at allows the air charged to flow 11 past the seal 60. This air flow 11 is directed into a lower annular chamber 48. The lower annular chamber 48 is formed between the interior surface of the outer cylinder 6 and the exterior surface of the middle cylinder 4. The lower annular chamber is bounded on the lower end be seal 12, which includes an "O"-ring that slideably and sealably engages the outer cylinder 6 and the middle cylinder 4. The lower annular chamber 48 is bounded at the upper end by the transfer valve body 42. Thus, the air charge in the upper annular chamber 46 is forced past seal 60 into the lower annular chamber on the down-stroke. By this action, seal 60 functions as a transfer check valve for the flow of air during the down-stroke. Therefore, item 60 is a seal on the up-stroke and a transfer valve on the down-stroke. Note that the volume of the upper annular chamber 46 at full extension of the pump is substantially larger than the volume of the lower annular chamber 48 at full compression of the pump. This differential in volume results in a compression of the air as it flows 11 into the lower annular chamber 48. The relationship of these volumes is better appreciated with reference to a section view taken across the vertical axis of the pump.

Figure 9:
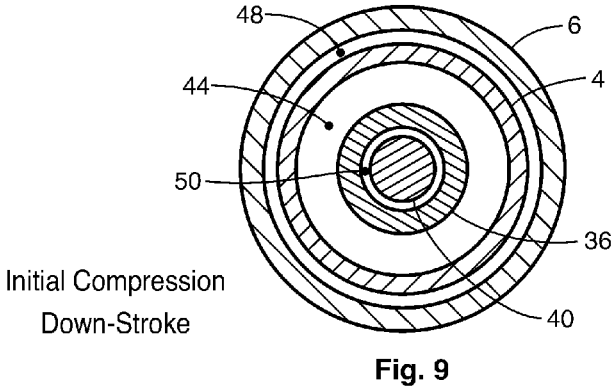
FIG. 9 is a section view drawing of a reciprocal pump according to an illustrative embodiment of the present invention.

Reference is directed to FIG. 9, which is a section view drawing of a reciprocal pump according to an illustrative embodiment of the present invention. This is a section view across the vertical axis of the pump, and illustrates the relative diameters of the various cylinders and the respective chambers that they define. The cylinders and piston rod in the illustrative embodiment are fabricated from mild steel. The space between the outer cylinder 6 and middle cylinder 4 define the cross sectional area of the lower annular chamber 48. This is much smaller than the cross sectional area of the upper annular chamber, which is the space between the outer cylinder 6 and the piston rod 40. The space between the middle cylinder 4 and the inner cylinder 36 defines the inlet annular chamber 44, which is not a compression chamber, but rather is a conduit for the flow of inlet air to the transfer valve body. For reference hereinafter, the space between the inner cylinder 36 and the piston rod 40 defines the rod chamber 50.

Figure 10:
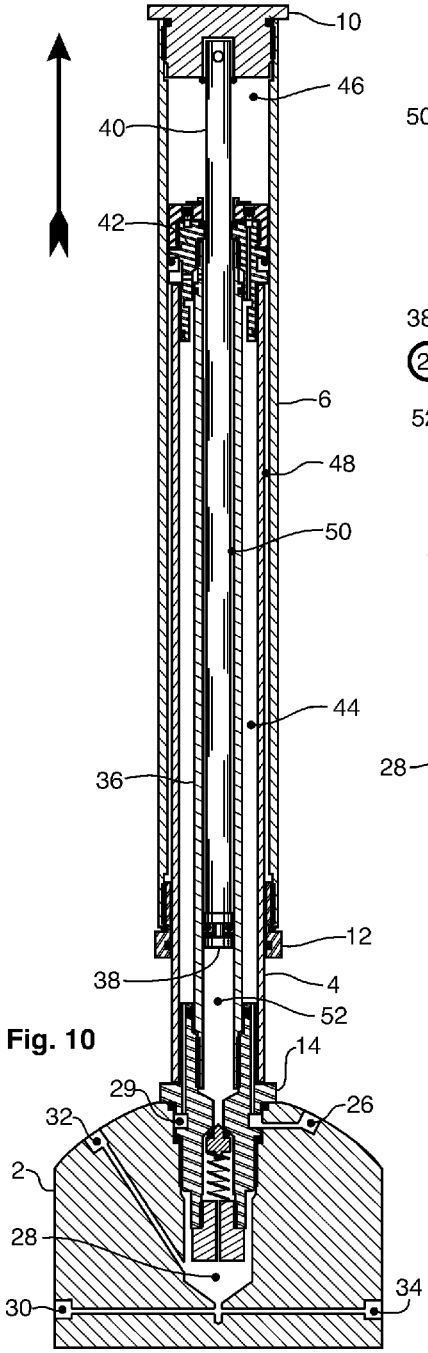
FIG. 10 is a section view drawing of a reciprocal pump illustrating the secondary compression stage on the up-stroke according to an illustrative embodiment of the present invention.
Figure 11:
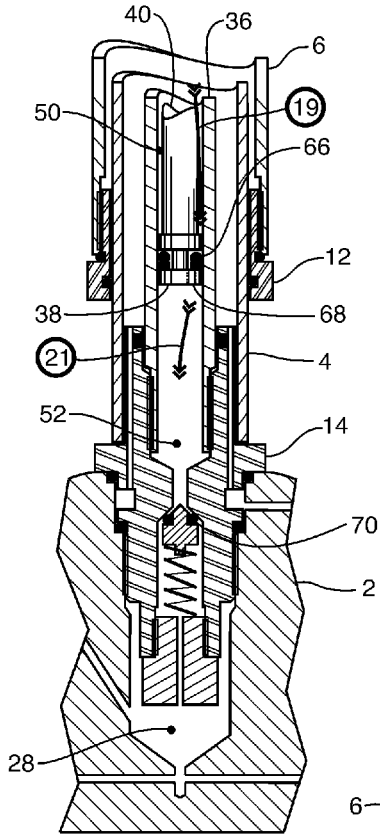
FIG. 11 is a detailed section view drawing of a reciprocal pump illustrating the secondary compression stage on the up-stroke according to an illustrative embodiment of the present invention.
Figure 12:
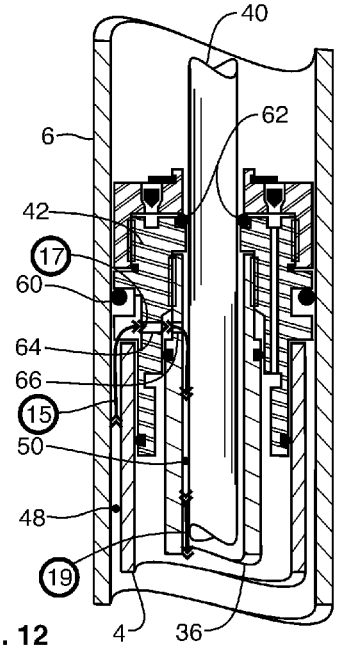
FIG. 12 is a detailed section view drawing of a reciprocal pump illustrating the secondary compression stage on the up-stroke according to an illustrative embodiment of the present invention.

Reference is directed to FIG. 10, FIG. 11, and FIG. 12, which are section view drawings, including detailed section view drawings, of a reciprocal pump illustrating the secondary compression stage on the up-stroke according to an illustrative embodiment of the present invention. In addition to the aforementioned ambient air intake process that occurs on the up-stroke, a secondary compression action also occurs on the up-stroke. The air that was compressed into the lower annular chamber 48 during the previous down-stoke is further compressed 15 on the up-stroke. Since the "O"-ring of seal 60 is urged upwardly on the up-stroke, the seal action is again perfected so the air charge in the lower annular chamber 48 is urged 17 through a transfer port 64 in the transfer valve body 42 and further urged 17 through a port 66 formed through the inner cylinder 36. This causes the air to compress 19 into the rod chamber 50. The rod chamber 50 is formed between the inner surface of the inner cylinder 36 and the piston rod 40. It is bounded on the lower end by piston 38 and on the upper end by transfer valve body 42, which is sealed to the piston rod 40 by "O"-ring seal 62. A piston check valve 66 allows the air flow 19 to pass through a piston port 68 formed in the piston 38 such that the air further compresses 21 into piston chamber 52. The piston check valve 66 comprises an "O"-ring the traverses an annular groove formed about the piston such that the "O"-ring is urged downwardly on the up-stroke so as to expose the piston port 68 to enable air flow 21 into the piston chamber 52. The piston chamber is defined by the interior of the inner cylinder, and is bounded by the piston 38 at the upper end and the outlet valve body 42 and outlet valve 70 at the lower end. On completion of the up-stroke, a charge of compressed air is transferred 15, 17, 19, 21 and further compresses from the lower annular chamber 48 into the piston chamber 52.

Figure 13:
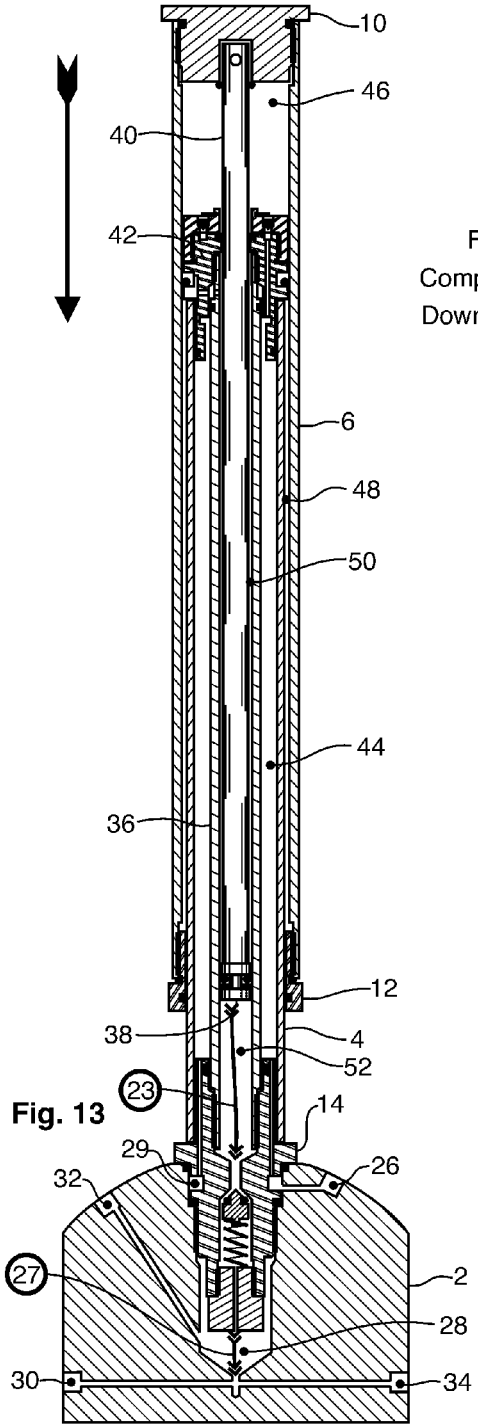
FIG. 13 is a section view drawing of a reciprocal pump illustrating the final compression stage on the down-stroke according to an illustrative embodiment of the present invention.
Figure 14:
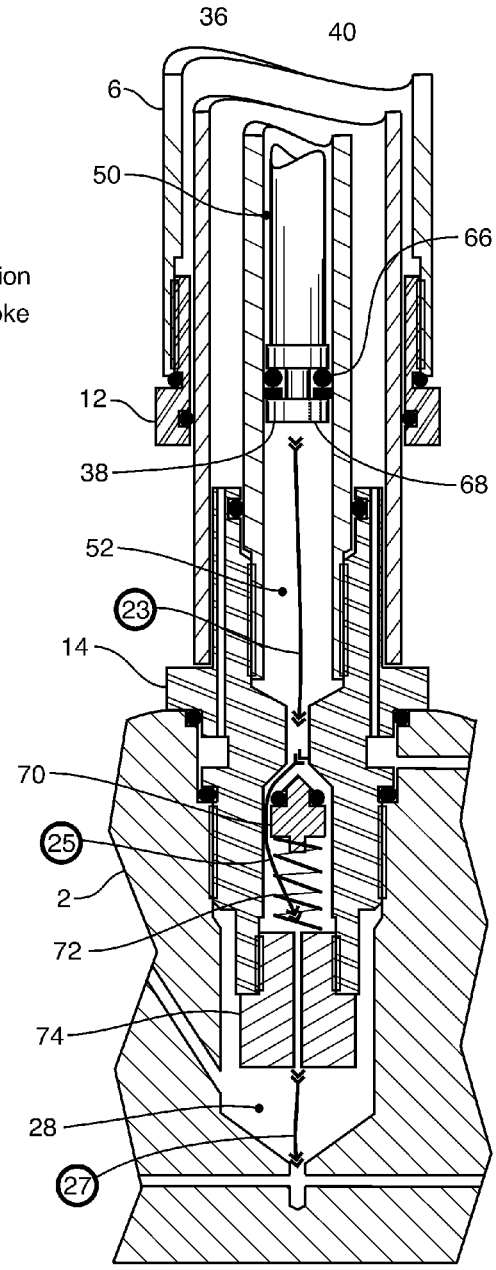
FIG. 14 is a detailed section view drawing of a reciprocal pump illustrating the final compression stage on the down-stroke according to an illustrative embodiment of the present invention.

Reference is directed to FIG. 13 and FIG. 14, which are a section view and detailed section view drawing of a reciprocal pump illustrating the final compression stage on the down-stroke according to an illustrative embodiment of the present invention. Upon initiation of the subsequent down-stroke, the "O"-ring in the piston check valve 66 is urged upwardly, which perfects a seal between the piston 38 and the interior surface of the inner cylinder, which effective seals the rod chamber 50 from the piston chamber 52. Further down-stroke movement compresses 23 the air charge in the piston chamber 52, which urges outlet valve 70 open, allowing air to flow past 25 the outlet valve 70 and into the 27 the outlet cavity 28 in the base housing 2. Note that the dramatic compression, reaching pressures in excess of 2000 psi, even as high as 3000 psi cause a great increase in the temperature of the compressed air and outlet valve body 14, as well as the outlet valve 70 itself. The annular chamber 29, through which the cool inlet air flows, serves to remove a portion of the heat generated at the outlet, thereby enhancing operation and performance of the reciprocal pump.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A multiple-chamber, multiple-stage reciprocal pump for compressing air through a series of up-strokes and down-strokes, comprising:

an upper reciprocal portion;

a fixed portion further comprising;

a base housing with an ambient air inlet cavity and a compressed air outlet cavity formed therein;

an outlet valve body threadably engaged with said base housing, said outlet valve body having an outlet valve which is pneumatically coupled to direct high-pressure compressed air into said outlet cavity, said outlet valve body also having an inlet port to receive inlet air from said inlet cavity, and wherein said inlet cavity and said inlet port are pneumatically coupled by an annular cavity defined between said base housing and said outlet valve body when threadably engaged together, and wherein said annular cavity is disposed about said outlet valve, and plural cylinders coupled to said outlet valve body, and slideably and sealably engaged with said upper reciprocal portion, thereby enabling the series of up-strokes and down-strokes to compress air.

2. The reciprocal pump of claim 1, and wherein said inlet port is arranged in thermally conductive proximity to said outlet valve, thereby enabling transfer of heat from compressed outlet air to ambient inlet air.

3. The reciprocal pump of claim 1, and wherein said inlet cavity is arranged in thermally conductive proximity to said outlet valve body, thereby enabling transfer of heat from compressed outlet air to ambient inlet air.

4. The reciprocal pump of claim 1, and wherein said annular cavity is arranged in thermally conductive proximity to said outlet valve, thereby enabling transfer of heat from compressed outlet air to ambient inlet air.

5. The reciprocal pump of claim 1, further comprising:

an inlet air filter coupled to said inlet cavity for filtering ambient air prior to entering the reciprocal pump.

6. The reciprocal pump of claim 1, and wherein said inlet cavity and inlet port are arranged in thermally conductive proximity to said outlet valve and said outlet cavity, thusly enabling transfer of heat from compressed outlet air to ambient inlet air.

7. The reciprocal pump of claim 1, further comprising:

a handle coupled to said upper reciprocal portion to facilitate manual operation of the reciprocal pump.

8. The reciprocal pump of claim 1, and wherein said base housing has cooling fins formed on the exterior surface thereof to facilitate heat transfer from said base housing to the ambient environment.

9. A reciprocal pump for compressing air by a series of up-strokes and down-strokes, comprising:

(a) a reciprocal portion, including;

an outer cylinder having a closed top at the upper end and a seal assembly at a lower end;

a piston rod, co-axially disposed within said outer cylinder, and fixed to said closed top at the upper end, and having a piston fixed to the lower end, said piston having a piston valve; and (b) a fixed portion, including;

a base housing with an ambient air inlet cavity and a compressed air outlet cavity formed therein;

an outlet valve body threadably engaged with said base housing, said outlet valve body having an outlet valve which is pneumatically coupled to said outlet cavity, said outlet valve body also having an inlet port to receive inlet air from said inlet cavity, and wherein said inlet cavity and said inlet port are pneumatically coupled by an annular cavity defined between said base housing and said outlet valve body when threadably engaged together, and wherein said annular cavity is disposed about said outlet valve;

a middle cylinder coupled to said outlet valve body at the lower end and coupled to a transfer valve body at the upper end;

an inner cylinder coaxially disposed within said middle cylinder, and coupled to said outlet valve body at the lower end and coupled to said transfer valve body at the upper end, and wherein said middle cylinder and said inner cylinder form an inlet annular chamber therebetween, which bounded by said outlet valve body and said transfer valve body, said inlet annular chamber pneumatically coupled to said inlet port, and wherein (c) said reciprocal portion slideably engages said fixed portion, and thusly enables the sequence of up-strokes and down-strokes, and wherein said outer cylinder, said middle cylinder, said inner cylinder and said piston rod are coaxially arranged in respective order of decreasing diameters, and wherein said transfer valve body sealably engages said piston rod and sealably engages an interior surface of said outer cylinder, thereby defining an upper annular chamber bounded by said transfer valve body and said closed top, and wherein said transfer valve body further includes an inlet valve disposed to direct the flow of air from said inlet air chamber into said upper annular chamber on the up-stroke, and wherein said seal assembly sealably engages an exterior surface of said middle cylinder, and thereby defines a lower annular chamber bounded by said seal assembly and said transfer valve body, and wherein said transfer valve body further includes a transfer valve disposed to direct the flow of air from said upper annular chamber to said lower annular chamber on the down-stroke, and wherein said piston sealably engages an interior of said inner cylinder and thereby defines a rod chamber bounded by said piston and said transfer valve body, and further defines a piston chamber bounded by said piston and said outlet valve body, and wherein said transfer valve body further includes a transfer port disposed to allow air to flow from said lower annular chamber into said piston rod chamber on the up-stroke, and wherein said piston valve directs the flow of air from said rod chamber to said piston chamber on the up-stroke, and wherein said outlet valve directs air the flow from said piston chamber to said outlet cavity on the down-stroke.

10. The reciprocal pump of claim 9, and wherein said inlet port is arranged in thermally conductive proximity to said outlet valve, thereby enabling transfer of heat from compressed outlet air to ambient inlet air.

11. The reciprocal pump of claim 9, and wherein said inlet cavity is arranged in thermally conductive proximity to said outlet valve body, thereby enabling transfer of heat from compressed outlet air to ambient inlet air.

12. The reciprocal pump of claim 9, and wherein said annular cavity is arranged in thermally conductive proximity to said outlet valve, thereby enabling transfer of heat from compressed outlet air to ambient inlet air.

13. The reciprocal pump of claim 9, further comprising:

an inlet air filter coupled to said inlet cavity for filtering ambient air prior to entering the reciprocal pump.

14. The reciprocal pump of claim 9, and wherein said inlet cavity and inlet port are arranged in thermally conductive proximity to said outlet valve and said outlet cavity, thusly enabling transfer of heat from compressed outlet air to ambient inlet air.

15. The reciprocal pump of claim 9, further comprising:

a handle coupled to said closed top to facilitate manual operation of the reciprocal pump.

16. The reciprocal pump of claim 9, and wherein said base housing has cooling fins formed on the exterior surface thereof to facilitate heat transfer from said base housing to the ambient environment.

* * * * *